US005081435A

United States Patent [19]

Yorita

[11] Patent Number: 5,081,435

[45] Date of Patent: Jan. 14, 1992

[54] DIELECTRIC FILTER

[75] Inventor: Tadahiro Yorita, Nagaokakyo, Japan

[73] Assignee: Murata Mfg. Co., Ltd., Japan

[21] Appl. No.: 535,418

[22] Filed: Jun. 8, 1990

[30] Foreign Application Priority Data

Jun. 8, 1989 [JP] Japan ..... 1-66965[U]
Jun. 22, 1989 [JP] Japan ..... 1-160541

[51] Int. Cl.[5] ..... H01P 1/202
[52] U.S. Cl. ..... 333/206; 333/202
[58] Field of Search ..... 333/202, 206, 207, 222, 333/223, 219

[56] References Cited

U.S. PATENT DOCUMENTS 4,276,525 6/1981 Nishikawa et al. ..... 333/206
4,567,454 1/1986 Saito ..... 333/206
4,800,347 1/1989 Yorita et al. ..... 333/222 X

FOREIGN PATENT DOCUMENTS 0020002 2/1983 Japan ..... 333/202
61-191101 8/1986 Japan .
0192101 8/1986 Japan ..... 333/202
61-193501 8/1986 Japan .
0237501 10/1986 Japan ..... 333/202
0023202 1/1987 Japan ..... 333/202
0050102 3/1988 Japan ..... 333/222
2174849A 11/1986 United Kingdom .
2224397A 5/1990 United Kingdom .

OTHER PUBLICATIONS

U.K. Search Report dated Oct. 8, 1990.

*Primary Examiner*—Eugene R. LaRoche
*Assistant Examiner*—Seung Ham
*Attorney, Agent, or Firm*—Ostrolenk, Faber, Gerb & Soffen

[57] ABSTRACT

A dielectric filter having band elimination characteristics includes a resonance circuit with a coupling terminal. A proximal portion of the coupling terminal and a ground electric potential portion of the filter are opposed in the vertical direction, and a stray capacitance element and an external coupling element are provided in the vertical direction between them. Thus it is possible to effect the mounting operation by first stacking the stray capacitance element and the external coupling element on the ground portion and on top of those securing the proximal portion of the coupling terminal. This structure simplifies the soldering and assembling operation, and also improves mass production.

13 Claims, 6 Drawing Sheets

DIELECTRIC FILTER

BACKGROUND OF THE INVENTION

The present invention generally relates to a dielectric filter which has band elimination characteristics with a resonance circuit having a dielectric resonator as a main body being connected through a coupling inductance.

FIG. 12 shows a conventional dielectric filter having band elimination characteristics. This filter is provided with a plurality of resonance circuits with capacitors 15 used for stray capacitance connected in parallel with a series circuit between a dielectric resonator 14 and a capacitor 13 used for external coupling.

In such a filter assembly construction as described above, a plurality of resonators 14 are accommodated within case 20, with internal conductors 14*a* being horizontal. A bent portion 17*a* on the proximal end of a ground plate 17 with a distal portion being grasped between the internal bottom face of case 20 and an external conductor 14*b* on the outer periphery of the resonator 14 is opposed in the horizontal direction by a coupling terminal 16 which is soldered to the internal conductor 14*a* and is externally exposed. The capacitors 13 and 15 are mounted one after another with solder 18 or the like between the opposing coupling terminal 16 and the bent portion 17*a*. The resonator 14 is supported by elastic pressure exerted by a spring 19 engaged between the resonator 14 and the upper internal face of the case 20, which opposes pressure exerted by the distal end of the ground plate 17 which is shaped into a wavelike form and is engaged between the bottom internal face of the case 20 and the resonator 14. Reference numeral 12 in FIG. 12 is a transmission line including a coupling inductance 11 engaged between the capacitor 13 and the capacitor 15, showing the cross of the transmission line.

In the above construction, separate capacitors 13 and 15 are used. In order to obtain the desired filter characteristics, the inductance and capacitance of each stage must be specified at a given value. Since all the values thereof are generally different, the parts which have various capacitances are conventionally required to be controlled for each determined value of capacitance.

Also, in the above described construction, since it is required to mount the capacitor to the resonator without any additional support, the assembling operation cannot be easily effected, thus resulting in improper mass production. The mounting operation is unstable, even when the soldering operation and other steps are effected with the capacitor being supported by grasping pressure between the coupling terminal 16 and the bending portion 17*a* by the use of the elasticity of the ground plate 17.

Also, as the space between the mounting portion A of the capacitor and the case connecting portion B in the ground plate 17 becomes longer, surplus inductance is caused resulting in unstable electric characteristics.

Further, since the capacitor is unsupported, the mechanical strength is weaker, so that the solder joint or the like may come off because of vibrations and the like.

SUMMARY OF THE INVENTION

Accordingly, an essential object of the present invention is to provide a dielectric filter which is capable of easier specification of capacitance and inductance values.

Another important object of the present invention is to provide an easily mounted dielectric filter which can restrain the causation of surplus inductance and increase mechanical strength.

In accomplishing these and other objects, according to one preferred embodiment of the present invention, a dielectric filter is provided with resonance circuits comprised of capacitors for stray capacitance connected in parallel with a series circuit between a dielectric resonator and a reactance element for external coupling. The adjacent resonance circuits are connected by a coupling inductance and the capacitors for stray capacitance of at least two resonance circuits use a common electrode plate. In the present invention of such construction as described hereinabove, at least two of the capacitors for stray capacitance are adapted to use a common electrode plate, so that the number of components of the capacitors required is decreased.

Also, the dielectric filter in accordance with the present invention is characterized in that the dielectric resonator is accommodated within the case, with the internal conductor disposed horizontally; the coupling terminal has a distal portion mounted on the internal conductor and a proximal portion projected in the horizontal direction beyond the resonator; a stray capacitance element; and an external coupling element connected in series with the transmission line and grasped between the proximal portion of the coupling terminal and the vertically opposed ground electric potential portion.

The internal bottom face of case 20 or a ground plate grasped between the dielectric resonator and the case internal bottom face may serve as the ground electric potential. In the present invention of such construction as described hereinabove, since the proximal portion of the coupling terminal and the ground electric potential portion are vertically opposed, and the stray capacitance element and the external coupling element are provided vertically between the proximal portion of the coupling terminal and the ground electric potential portion, the mounting operation may be effected with the element on the upper side being placed subsequent to the element on the lower side having been mounted.

BRIEF DESCRIPTION OF THE DRAWINGS

These and other objects and features of the present invention will become apparent from the following description of preferred embodiment thereof with reference to the accompanying drawings, in which.

DETAILED DESCRIPTION OF THE INVENTION

Figure 1:
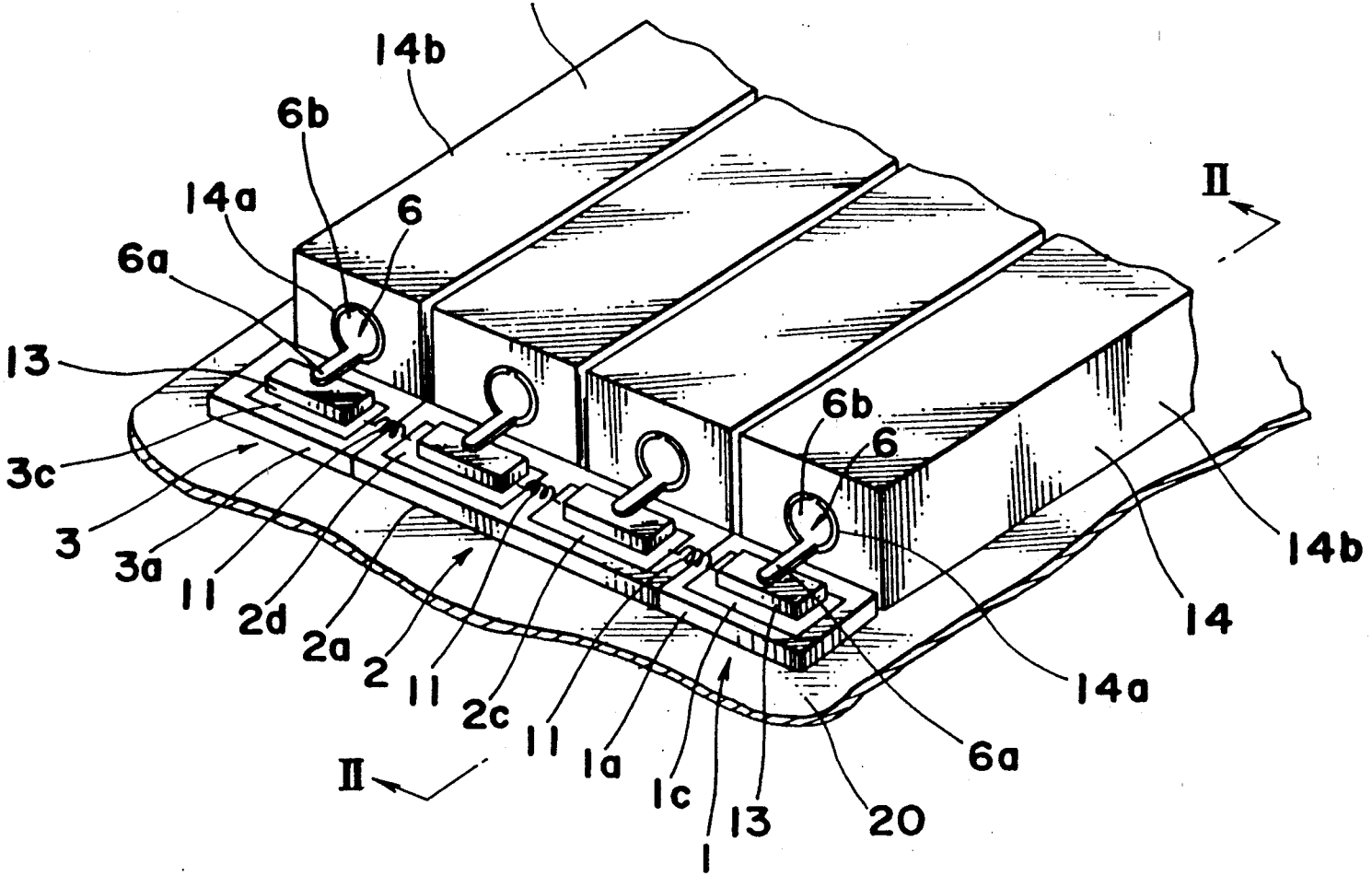
FIG. 1 is a perspective view showing a band elimination filter according to a first embodiment of the present invention.

Before the description of the present invention proceeds, it is to be noted that like parts are designated by like reference numerals throughout the accompanying drawings.

First Embodiment

Figure 2:
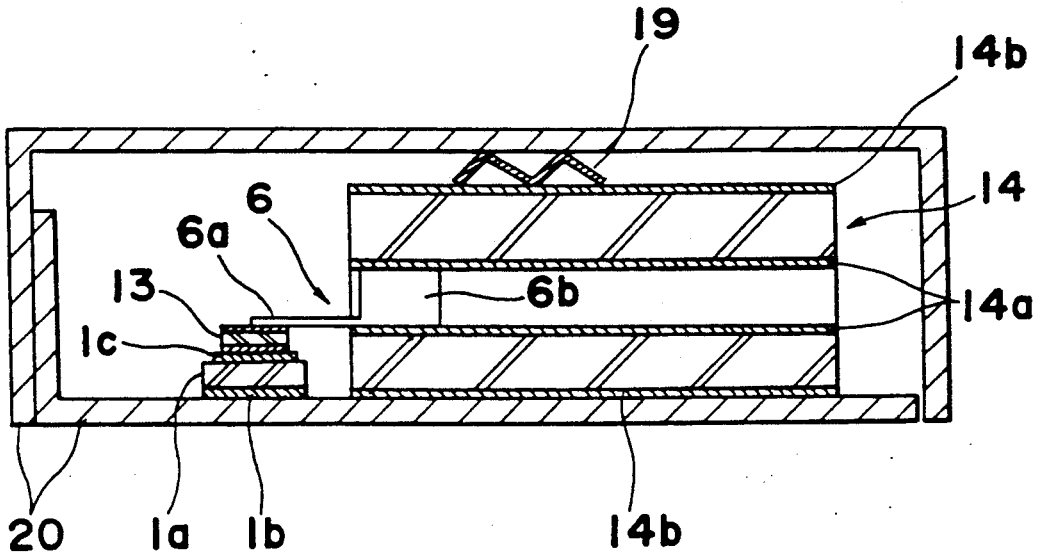
FIG. 2 is a sectional view taken along a line II—II of FIG. 1.
Figure 3:
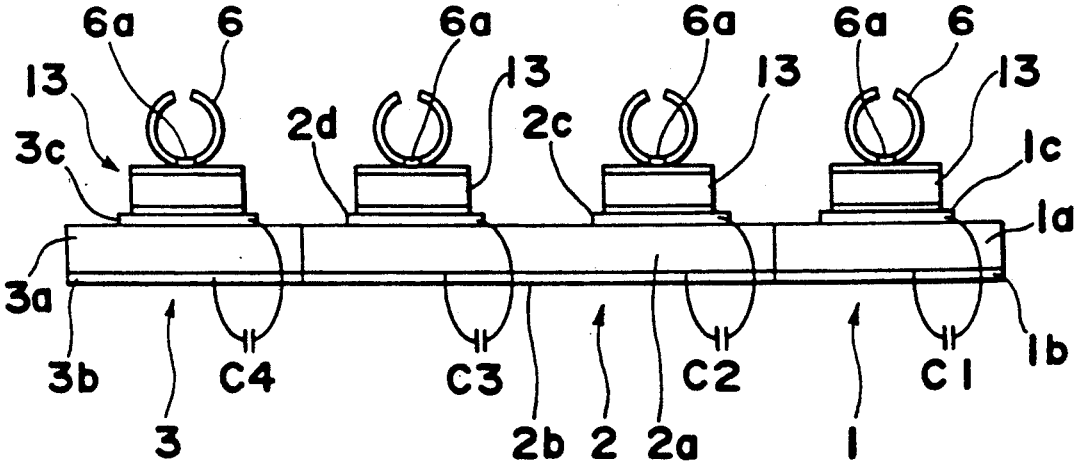
FIG. 3 is a front face view showing portions of FIG. 1.
Figure 6:
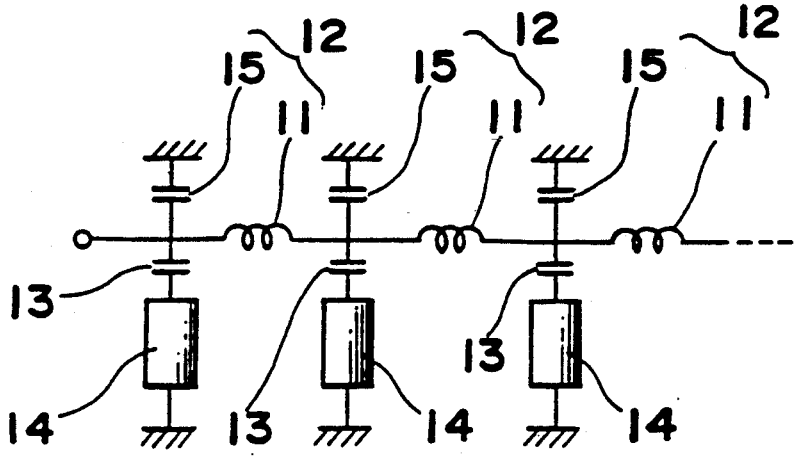
FIG. 6 is an equivalent circuit diagram of a band elimination filter.

FIG. 1 is a perspective view showing a band elimination filter according to a first embodiment of the present invention. FIG. 2 is a sectional view taken along a line II—II thereof. FIG. 3 is a front face view showing portions of FIGS. 1 and 2. The equivalent circuit of the filter is the same as the circuit shown in FIG. 6. A capacitor 15 and a coil 11 constitute a grounded transmission line 12. Between the connection point of the capacitor 15 and coil 11 and ground, the circuit of the filter has a capacitor 13 for adjusting the external Q connected in series with a dielectric resonator 14. The capacitor 15 for stray capacitance is connected in parallel with the capacitor 13 and resonator 14 which are integratedly made constant at LC.

In the construction of the filter itself, dielectric resonators 14, four for example which are, square pillar shaped, are accommodated within the case 20, with the internal conductor 14*a* being horizontal, and an external conductor 14*b* of each resonator 14 in contact with case 20. Case 20 is grounded, and the respective external conductors 14*b* are also grounded.

The internal conductor 14*a* of the resonator 14 is formed into a cylindrical shape. The coupling terminal 6 which also has the distal portion 6*b* formed into a cylindrical shape is made of a conductive material and is mounted with the distal portion 6*b* within the internal conductor 14*a*. The proximal portion 6*a* of coupling terminal 6 is almost horizontal and is adapted to oppose the inner bottom face of the case 20 in the vertical direction.

Three capacitor elements 1, 2, 3 for stray capacitance are provided on the internal bottom face of case 20 opposite to the proximal portion 6*a* of coupling terminal 6. The elements 1 and 3 of the three capacitor elements 1, 2, and 3 have capacitors C1, and C4 formed between electrodes 1*b* and 1*c*, and 3*b* and 3*c*, respectively, with the full-face electrodes 1*b*, and 3*b* formed on the under surface of plates 1*a*, and 3*a* said plates composed of the dielectric material, and the electrodes 1*c* and 3*c* formed on part of the upper faces of plates 1*a* and 3*a* below the lower portion of the proximal portion 6*a* of coupling terminal 6. The full-face electrodes 1*b* and 3*b* on the lower side are grounded in contact to case 20.

The element 2 which is disposed between elements 1 and 3 has capacitors C2 and C3 formed between electrodes 2*b* and 2*c*, and electrodes 2*b* and 2*d*, respectively with the full-face electrode 2*b* formed on the under surface of plate being 2*a* said plate composed of a dielectric material, and the electrodes 2*c* and 2*d* formed on part of the upper face of plate 2*a*, below the lower portion of the proximal portions 6*a* of two intermediate coupling terminals 6. The full-face electrode 2*b* on the lower side is grounded in contact to case 20.

The reactance elements for external coupling such as capacitors 13, are electrically connected to each of electrodes 1*c*, 2*c*, 2*d*, 3*c* formed on the top faces of such three elements 1, 2, 3 as described hereinabove, and also, coupling inductances 11 are connected between the adjacent electrodes. Although these connections may be separately soldered among the adjacent electrodes, they may also be all soldered at the same time by reflow soldering of VPS or the like. Also, the reactance elements for external coupling are further utilized to adjust the Q value.

The proximal portion 6*a* of coupling terminal 6 is connected with the top face electrode of the capacitor for external coupling 13 so as to constitute the filter of the present invention. The capacitor elements 1, 2, 3 for stray capacitance are separate elements despite their similarity and their proximity to one another. The first and final stages corresponding to capacitor elements 1 and 3, which are disposed on both sides of element 2, use a different dielectric constant so as to increase the capacitance as compared to the capacitance of the central portion. In a case where the capacitance may be adjusted by the electrode size or the like, the capacitor elements are not required to be separated. The capacitor elements for stray capacitance 1, 2, 3 may be integrated with one common electrode plate.

Figure 4:
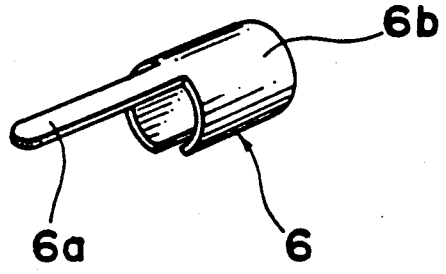
FIG. 4 is a perspective view showing an example of a mounting and coupling terminal.

Coupling terminal 6 may be mounted so that the proximal portion 6*a* may be directed at any circumferential direction of the internal conductor 14*a*, and the coupling terminal may be formed in accordance with the total height of the capacitors for stray capacitance 1, 2, 3, the capacitor for external coupling 13, etc. The coupling terminal 6 may be mounted so that the proximal portion 6*a* is positioned on the upper side as shown for example, in FIG. 4.

Figure 5:
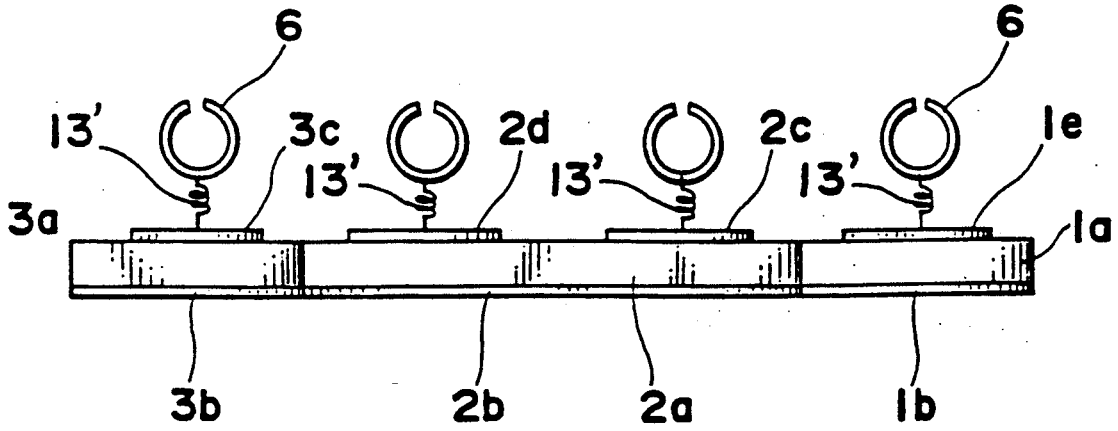
FIG. 5 is a front face view showing a modification of the first embodiment of the present invention.

FIG. 5 is a perspective view showing a modified embodiment of the present invention. In this filter, a coil for external coupling 13' instead of a capacitor 13 for external coupling has been mounted. Even in this case, the present invention may be applied.

Although the underside of the capacitor elements for stray capacitance 1, 2, 3 are formed with full-face electrodes 1*b*, 2*b*, 3*b* in the above described embodiment, the present invention is not restricted to it. The electrodes 1*b*, 2*b*, 3*b* may also be formed in the same sizes as electrodes 1*c*, 2*c*, 2*d*, 3*c* on the top faces.

Also, although the present invention is applied to a filter composed of four stages in the above described embodiment, the present invention is not restricted to it. The present invention may be, needless to say, applied to filters of greater or lesser numbers of stages.

Further, although square-shaped pillers are used as the dielectric resonators in the above described dielectric resonator, the present invention is not restricted to it. Needless to say, cylindrical dielectric resonators may be used. In the present invention as described in detail hereinabove, at least two of the capacitors for stray capacitance are adapted to use a common electrode plate so that the number of parts in the capacitors may be reduced, and that the parts controlling operation may be simplified.

Second Embodiment

Figure 7:
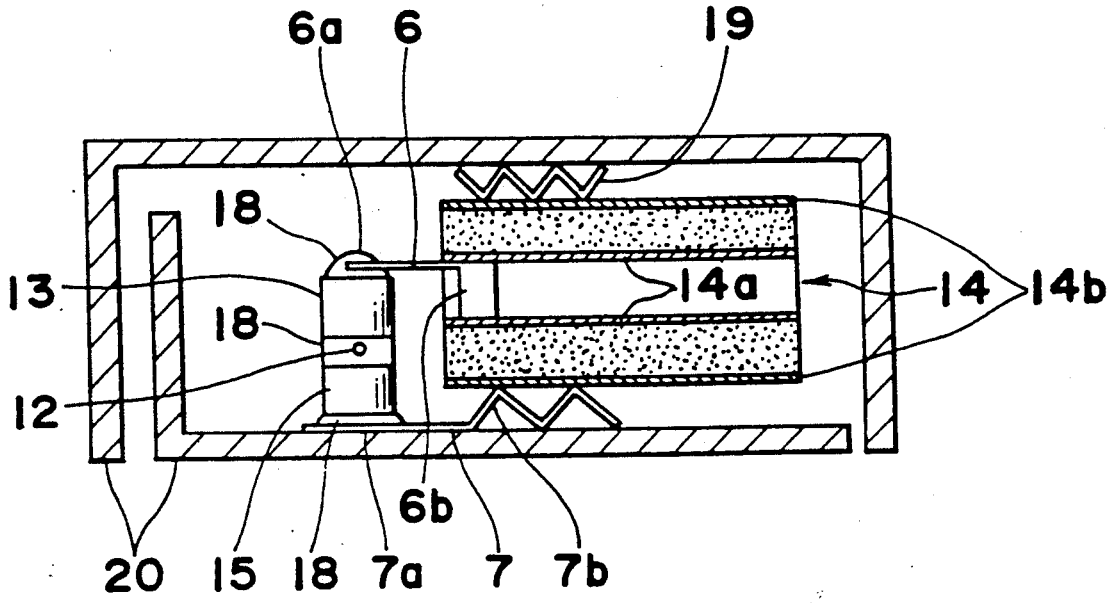
FIG. 7 is a sectional view showing a band elimination filter according to a second embodiment of the present invention.
Figure 8:
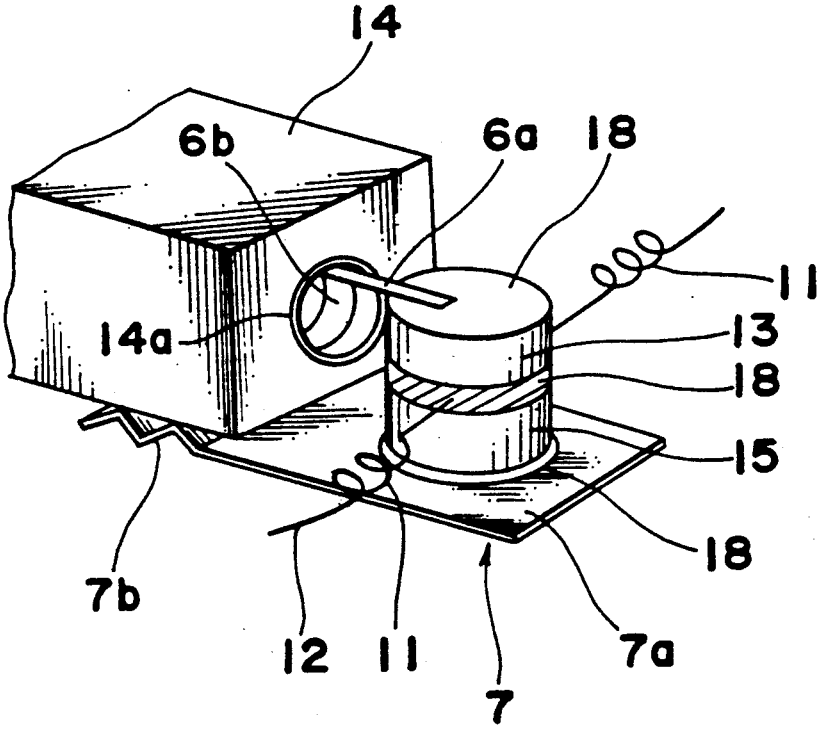
FIG. 8 is a perspective view showing portions of FIG. 7.

FIG. 7 is a sectional view showing a band elimination filter according to a second embodiment of the present invention. FIG. 8 is a perspective view showing portions thereof, with like parts being designated by like reference numerals in FIG. 1 and FIG. 2. This filter is the same as in the circuit shown in FIG. 6, with, for example, the square-pillar-shaped dielectric resonator 14 being accommodated within case 20 and the internal conductor 14a disposed horizontally.

A ground electric potential portion such as the distal portion 7b of the ground plate 7 is inserted between the external conductor 14b of resonator 14 and the internal bottom face of case 20. The distal portion 7b is shaped into a wavelike form, with the proximal portion 7a projected beyond the resonator 14 and formed straight and directed horizontally along the internal bottom face of case 20. The proximal portion 7a is provided to come into contact with the internal bottom face of case 20 so that it is preferably not shaken by vibrations.

The internal conductor 14a of resonator 14 is formed into a cylindrical shape. The coupling terminal 6 which also has the distal portion 6b formed into a cylindrical shape is made of a conductive material and is mounted with the distal portion 6b inserted into the internal conductor 14a. The proximal portion 6a of coupling terminal 6 is formed to oppose the proximal portion 7a of the ground plate 7.

The disk-shaped capacitor for stray capacitance use 15 and the capacitor (external coupling element) 13 for adjusting the external portion Q are disposed between the horizontally disposed proximal portion 6a of the coupling terminal 6 and proximal portion 7a of ground plate 7. A transmission line 12 having a coil 11 is grasped between the two capacitors 15 and 13. In order to form this portion, the capacitor 15 for stray capacitance is soldered (solder joints are indicated at 18) on the proximal end 7a of the ground plate 7, and the capacitor for adjusting the external portion Q 13 is soldered to the transmission line 12 having the coil 11 grasped on it. Thereafter, the proximal end 6a of the coupling terminal 6 which is extended from the internal conductor 14b is soldered on the capacitor 13. It is to be noted that these connections may be effected at the same time by the reflow soldering such as VPS or the like although the soldering operations may be effected separately as described hereinabove.

Figure 9:
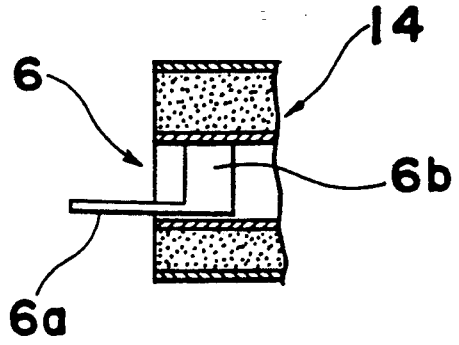
FIG. 9 is a sectional view showing an example of a mounting and coupling terminal.

The mounting operation with respect to the internal conductor 14a of the coupling terminal 6 may be effected so that the proximal portion 6a may be directed at any circumferential direction of the internal conductor 14a, and may be specified in accordance with the total height of the capacitors 15, 13, etc. for stray capacitance and for adjusting the external portion Q. The coupling terminal 6 may be mounted so that the proximal portion 6a may be positioned on the lower side as in, for example, FIG. 9.

An advantage of the present invention is that since the coupling terminal may be mounted simply by the insertion of the resonator into the internal conductor, manufacturing is made simpler as compared with the conventional method of soldering the coupling terminal in the case.

Third Embodiment

Figure 11:
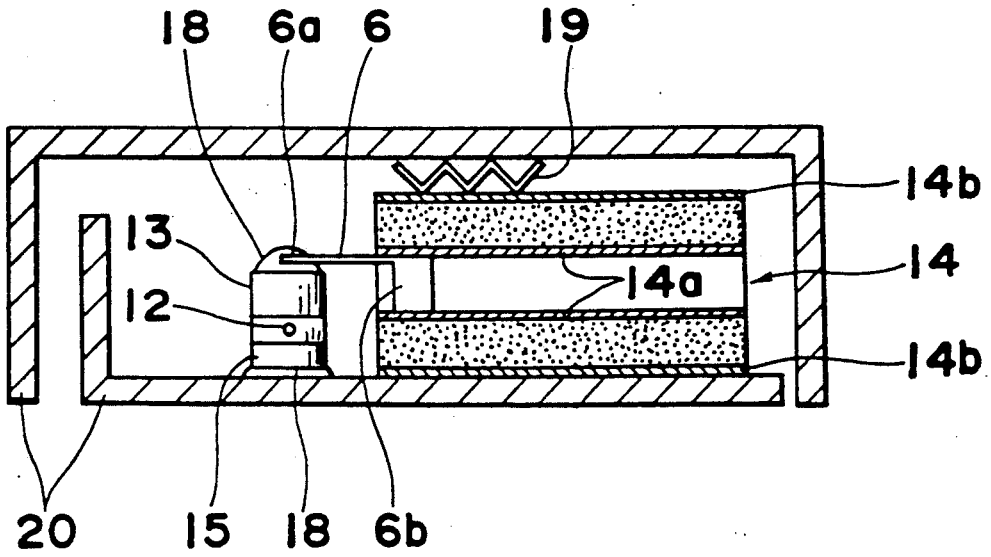
Figure 12:
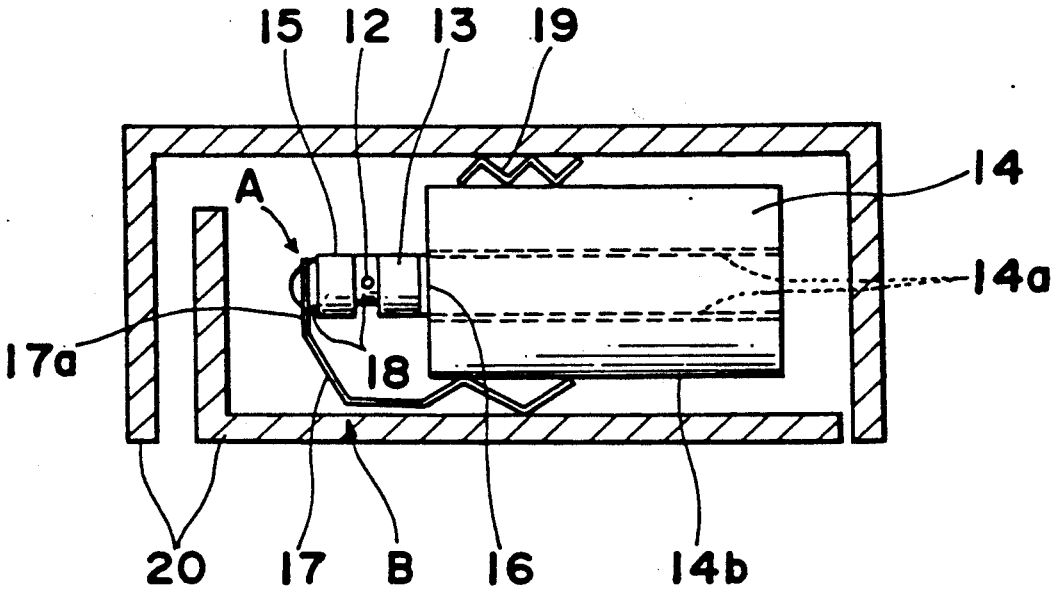
Fig. 12 PRIOR ART
FIG. 12 is a sectional view showing the construction of a conventional band elimination filter.

Although the ground plate 7 is used as the ground electric potential portion in the above described embodiment, the present invention is not restricted to it. Such construction as shown in FIG. 11 may be used without the use of the ground plate 7. Namely, case 20 may be grounded with the capacitor for stray capacitance 15 and the capacitor for adjusting the external portion Q may be provided on the internal bottom face of case 20, and the proximal portion 6a of the coupling terminal 6 mounted on the internal conductor 14a of the dielectric resonator 14 may be connected with the capacitor for adjusting the external portion Q on the upper side. That is, case 20 may be used as the ground electric potential portion.

Also, the capacitor for stray capacitance 15 and the capacitor for adjusting the external portion Q 13 may be square or the like instead of such disk shape as described hereinabove.

Fourth Embodiment

Figure 10:
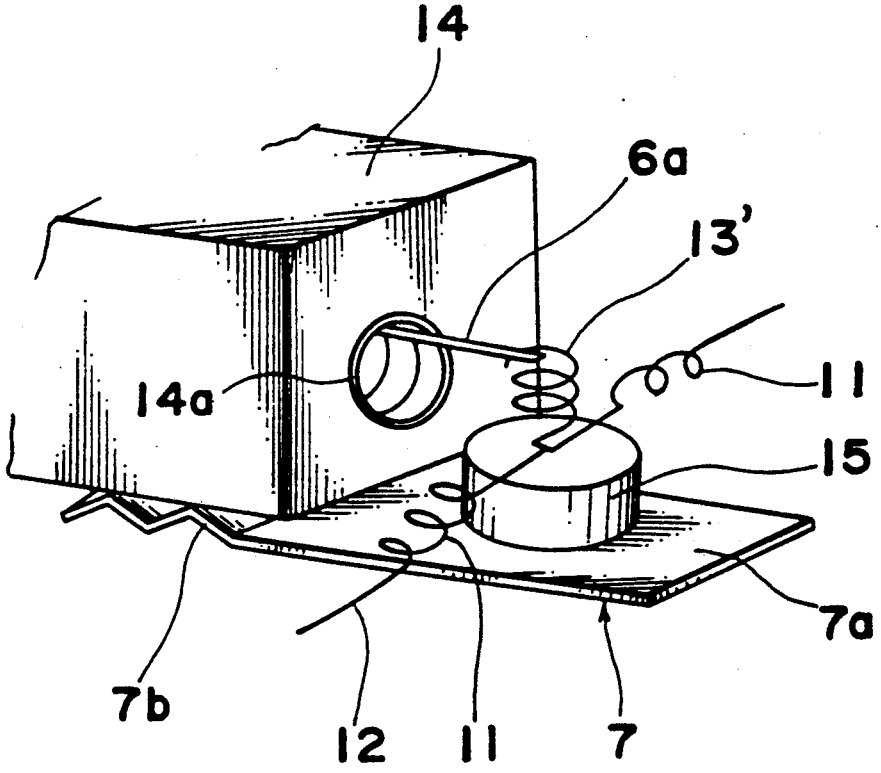
FIG. 10 and FIG. 11 are a perspective view and a sectional view, respectively showing fourth and third embodiments of the present invention.

FIG. 10 is a perspective view showing still another embodiment of the present invention. In this filter, a coil 13' is provided for adjusting the external portion Q (external coupling element) instead of a capacitor are mounted in the filter. When the coil 13' is used, no disadvantageous electric characteristics arise when the passing band of the filter is on the lower pass side than the attenuation band.

Although a square shape is used as the dielectric resonator 14 in the above described embodiment, the present invention is not restricted. A disk shape or the like dielectric resonator can also be used.

Also, the "horizontal and vertical" references in the present invention are not absolute. Rather they show the relative position relationship in a certain one embodiment for easier understanding.

As is clear from the foregoing description, according to the arrangement of the present invention, the proximal portion of the coupling terminal piece and the ground electric potential portion are opposed in the vertical direction, and the stray capacitance element and the external coupling element are stacked in the vertical direction between them in the embodiments of the present invention as described in detail hereinabove, so that it is possible to effect the mounting operation with the element on the lower side of the case already secured, and thereafter the element on the upper side being placed on it, thus simplifying the soldering and assembling operation, and also, improving mass production.

Also, even when the ground electric potential portion is a ground plate or when it is a case, the space between it and the case is so small that the causation of surplus inductance may be restrained thus stabilizing the electric dielectric characteristics. Since it is in contact with the case even when the ground electric potential portion is a ground plate, mechanical strength is improved and is stronger against vibrations, thus preventing the mounting portion of the soldering or the like from coming off.

Although embodiments of the present invention have been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric filter comprising a plurality of resonance circuits, each resonance circuit comprising:

a capacitor for stray capacitance connected in parallel with a series circuit comprising a dielectric resonator and a reactance element for external coupling; each pair of adjacent resonance circuits being interconnected by a coupling inductance, and said capacitors for stray capacitance of at least two of said resonance circuits having a common electrode plate.

2. A dielectric filter comprising:

at least one dielectric resonator accommodated within a case of said dielectric filter with an internal conductor thereof being substantially horizontal; a coupling terminal, a distal portion of said coupling terminal being fitted to said internal conductor and a proximal portion of said coupling terminal projecting substantially horizontally beyond said dielectric resonator;

said proximal portion of said coupling terminal being engaged to an external coupling element; said dielectric resonator and said external coupling element forming a series circuit;

said series circuit being connected in parallel with a stray capacitance element and further connected in series with a coupling element; said coupling element being connected to a connection point of said external coupling element and said stray capacitance element; and said external coupling element and said stray capacitance element being stacked vertically between said proximal portion of said coupling terminal and a vertically opposed ground electric potential portion of said filter.

3. A dielectric filter in accordance with claim 2, wherein the ground electric potential portion is an internal face of said case.

4. A dielectric filter in accordance with claim 2, wherein said ground electric potential portion is a ground plate grasped between said dielectric resonator and an internal face of said case.

5. A dielectric filter described in accordance with claim 3, wherein said external coupling element is a capacitor.

6. A dielectric filter described in accordance with claim 4, wherein said external coupling element is a capacitor.

7. A dielectric filter described in accordance with claim 3, wherein said external coupling element is an inductor.

8. A dielectric filter described in accordance with claim 4, wherein said external coupling element is an inductor.

9. A dielectric filter described in accordance with claim 1, wherein said reactance element for external coupling is a capacitor.

10. A dielectric filter described in accordance with claim 1, wherein said reactance element for external coupling is an inductor.

11. A dielectric filter described in accordance with claim 2, wherein said distal portion of said coupling terminal has means permitting said distal portion to be fitted to said internal conductor of said dielectric resonator with the proximal portion of said coupling terminal being oriented so as to accommodate the total height of said external coupling element and said stray capacitance element between said proximal portion and said vertically opposed ground electric potential portion of said filter.

12. A dielectric filter described in accordance with claim 3, wherein said distal portion of said coupling terminal has means permitting said distal portion to be fitted to said internal conductor of said dielectric resonator with the proximal portion of said coupling terminal being oriented so as to accommodate the total height of said external coupling element and said stray capacitance element between said proximal portion and said vertically opposed ground electric potential portion of said filter.

13. A dielectric filter described in accordance with claim 4, wherein said distal portion of said coupling terminal has means permitting said distal portion to be fitted to said internal conductor of said dielectric resonator with the proximal portion of said coupling terminal being oriented so as to accommodate the total height of said external coupling element and said stray capacitance element between said proximal portion and said vertically opposed ground electric potential portion of said filter.

* * * * *